US009791820B2

(12) United States Patent
Kato

(10) Patent No.: US 9,791,820 B2
(45) Date of Patent: Oct. 17, 2017

(54) IMAGE FORMING APPARATUS HAVING HEATING BODY, ELECTRIC POWER SUPPLY, AND CONTROLLER

(71) Applicant: Brother Kogyo Kabushiki Kaisha, Nagoya-shi, Aichi-ken (JP)

(72) Inventor: Yasutada Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/280,109

(22) Filed: Sep. 29, 2016

(65) Prior Publication Data

US 2017/0090398 A1 Mar. 30, 2017

(30) Foreign Application Priority Data

Sep. 30, 2015 (JP) ..... 2015-193903

(51) Int. Cl.
*G03G 15/00* (2006.01)
*G03G 15/20* (2006.01)

(52) U.S. Cl.
CPC ..... *G03G 15/80* (2013.01); *G03G 15/20* (2013.01)

(58) Field of Classification Search
USPC ..... 399/38, 67–69, 75, 88
See application file for complete search history.

(56) References Cited

U.S. PATENT DOCUMENTS 5,966,562 A * 10/1999 Maehara ..... G05D 23/1913 219/494
7,683,297 B2 * 3/2010 Kishi ..... G03G 15/2039 219/619
8,849,141 B2 9/2014 Takeuchi
9,031,443 B2 * 5/2015 Kaida ..... G03G 15/205 399/12
9,122,218 B2 * 9/2015 Koyama ..... G03G 15/2039
9,223,265 B2 * 12/2015 Itoh ..... G03G 15/50
9,335,709 B2 * 5/2016 Iwasaki ..... G03G 15/80
2012/0263489 A1 10/2012 Takeuchi

FOREIGN PATENT DOCUMENTS

JP H08-241011 A 9/1996
JP 2006-154341 A 6/2006
JP 2012-220905 A 11/2012

* cited by examiner

*Primary Examiner* — Hoan Tran
(74) *Attorney, Agent, or Firm* — Banner & Witcoff, Ltd.

(57) ABSTRACT

While a continuous conveying process is being executed, a first output process is executed at a timing prior to a prescribed timing, and a second output process is executed for a prescribed period from the prescribed timing. The prescribed timing is prior to a timing at which each recording sheet reaches a heating body. The first output process is for controlling an electric power supply to output electric power to a heat source configured to heat the heating body. The second output process is for controlling the electric power supply to output electric power to the heat source such that an output level of the electric power that is outputted from the electric power supply in the second output process has a tendency to become higher than an output level of the electric power that is outputted from the electric power supply in the first output process.

20 Claims, 8 Drawing Sheets

IMAGE FORMING APPARATUS HAVING HEATING BODY, ELECTRIC POWER SUPPLY, AND CONTROLLER

CROSS REFERENCE TO RELATED APPLICATION

This application claims priority from Japanese Patent Application No. 2015-193903 filed Sep. 30, 2015. The entire content of the priority application is incorporated herein by reference.

TECHNICAL FIELD

The present disclosure relates to an image forming apparatus provided with a controller for controlling a fixing device, and to a method for controlling the fixing device. The present disclosure also relates to a storage medium storing a program for operating the controller.

BACKGROUND

An image forming apparatus includes a fixing device for thermally fixing an image onto a sheet. The fixing device includes a heat roller and a pressure roller. At the first printing time, the image forming apparatus prints an image on a sheet for the first time after the image forming apparatus received a print instruction. At the first printing time, insufficient image fixing may occur because the pressure roller in the cold state draws heat from the heat roller and the surface temperature of the heat roller becomes extremely low.

Japanese Patent Application Publication No. Hei 8-241011 discloses a technique for restraining such an insufficient image fixing by forcibly lighting up a heater before a sheet reaches the fixing device for the first time after the image forming apparatus received a print instruction.

SUMMARY

It is an object of the disclosure in particular an embodiment described herein to restrain insufficient image fixing.

These and other objects will be attained by providing an image forming apparatus including: a heating body; a heat source; an electric power supply; a conveying mechanism; and a controller. The heating body is configured to thermally fix developing agent onto a recording sheet. The heat source is configured to heat the heating body. The electric power supply is configured to supply electric power to the heat source. The conveying mechanism is configured to convey the recording sheet to the heating body. The controller is configured to control the electric power supply and the conveying mechanism. The controller is configured to perform:

executing a continuous conveying process to control the conveying mechanism to continuously convey a plurality of recording sheets in succession to the heating body;

while executing the continuous conveying process, executing a first output process at a timing prior to a prescribed timing, the first output process being for controlling the electric power supply to output electric power to the heat source, the prescribed timing being prior to a timing at which each recording sheet reaches the heating body; and while executing the continuous conveying process, executing a second output process for a prescribed period from the prescribed timing, the second output process being for controlling the electric power supply to output electric power to the heat source such that an output level of the electric power that is outputted from the electric power supply in the second output process has a tendency to become higher than an output level of the electric power that is outputted from the electric power supply in the first output process.

In another aspect of the disclosure, there is provided a method for controlling an electric power supply to supply electric power to a heat source and control a conveying mechanism to convey a recording sheet. The heat source is configured to heat a heating body. The heating body is configured to thermally fix developing agent onto a recording sheet conveyed by the conveying mechanism. The method includes:

executing a continuous conveying process to control the conveying mechanism to continuously convey a plurality of recording sheets in succession to the heating body;

while executing the continuous conveying process, executing a first output process at a timing prior to a prescribed timing, the first output process being for controlling the electric power supply to output electric power to the heat source, the prescribed timing being prior to a timing at which each recording sheet reaches the heating body; and while executing the continuous conveying process, executing a second output process for a prescribed period from the prescribed timing, the second output process being for controlling the electric power supply to output electric power to the heat source such that an output level of the electric power that is outputted from the electric power supply in the second output process has a tendency to become higher than an output level of the electric power that is outputted from the electric power supply in the first output process.

In still another aspect of the disclosure, there is provided a non-transitory computer-readable recording medium storing computer-readable instructions for a controller. The controller is configured to control an electric power supply to supply electric power to a heat source and control a conveying mechanism to convey a recording sheet. The heat source is configured to heat a heating body. The heating body is configured to thermally fix developing agent onto a recording sheet conveyed by the conveying mechanism. The computer-readable instructions, when executed by a processor of the controller causes the controller to perform:

executing a continuous conveying process to control the conveying mechanism to continuously convey a plurality of recording sheets in succession to the heating body;

while executing the continuous conveying process, executing a first output process at a timing prior to a prescribed timing, the first output process being for controlling the electric power supply to output electric power to the heat source, the prescribed timing being prior to a timing at which each recording sheet reaches the heating body; and while executing the continuous conveying process, executing a second output process for a prescribed period from the prescribed timing, the second output process being for controlling the electric power supply to output electric power to the heat source such that an output level of the electric power that is outputted from the electric power supply in the second output process has a tendency to become higher than an output level of the electric power that is outputted from the electric power supply in the first output process.

BRIEF DESCRIPTION OF THE DRAWINGS

The particular features and advantages of the disclosure will become apparent from the following description taken in connection with the accompanying drawings, in which.

DETAILED DESCRIPTION

An image forming apparatus according to one embodiment will be described while referring to FIGS. 1 through 6. First, a general configuration of a color printer 1 as an example of the image forming apparatus will be described with reference to FIG. 1.

Throughout the specification, the terms "above", "below", "right", "left", "front", "rear" and the like will be used assuming that the color printer 1 is disposed in an orientation in which it is intended to be used. More specifically, a right side, a left side, a near side and a far side in FIG. 1 will be referred to as a front side, a rear side, a left side and a right side of the color printer 1, respectively. A vertical direction in FIG. 1 will be referred to as a vertical (up-down) direction of the color printer 1.

Figure 1:
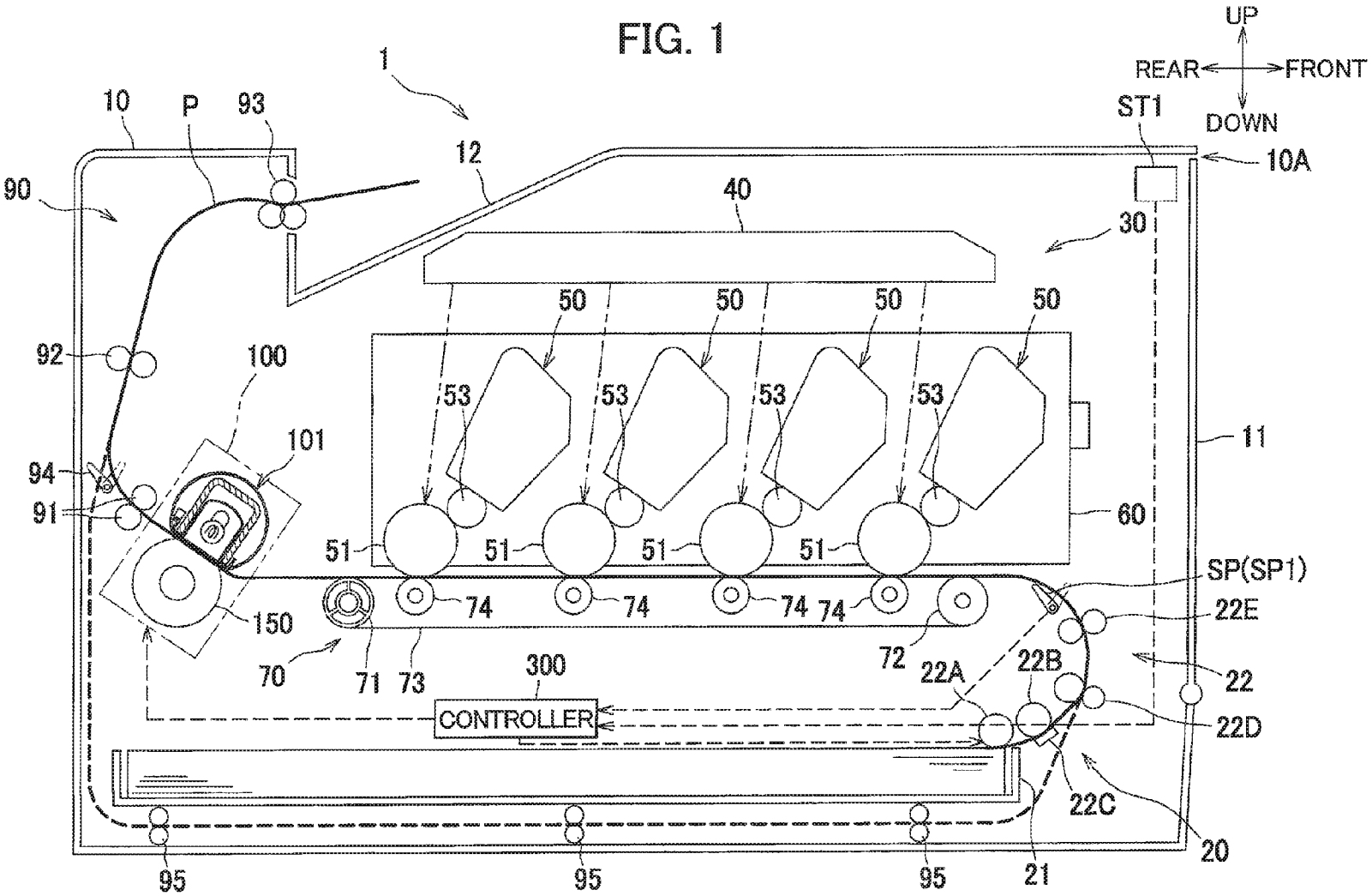
FIG. 1 is a cross-sectional view of a color printer as an example of an image forming apparatus according to one embodiment.

As shown in FIG. 1, the color printer 1 includes a main frame 10 in which a sheet supply unit 20 for supplying a sheet P, an image forming unit 30 for forming an image on the sheet supplied by the sheet supply unit 20, and a sheet conveying unit 90 are provided. The main frame 10 has a front opening 10A, and a front cover 11 is pivotally movably supported to a front end portion of the main frame 10 for opening and closing the front opening 10A.

The sheet supply unit 20 includes a sheet tray 21 accommodating the sheets P and a sheet-conveying mechanism 22 for conveying the sheets P from the sheet tray 21 to the image-forming unit 30.

The sheet-conveying mechanism 22 includes a pick-up roller 22A for picking up a sheet P on the sheet tray 21 and sending the sheet P out of the sheet tray 21, a separation roller 22B and a separation pad 22C for separating a sheet from other remaining sheets, a paper dust removing roller 22D for removing paper dust on the sheet P, and a registration roller 22E for aligning a leading edge of the sheet with a correct orientation. A sheet passage sensor SP as an example of a sheet sensor is provided downstream of the registration roller 22E and upstream of the image forming unit 30 in a sheet conveying direction. The sheet passage sensor SP is configured to detect whether a sheet P exists at the sheet passage sensor SP.

The sheet passage sensor SP includes a pivot arm SP1 pivotally movably supported to the main frame 10, and an optical sensor (not shown) adapted to detect pivotal movement of the pivot arm SP1. In the depicted embodiment, the optical sensor is rendered ON from OFF when the pivot arm SP1 is tumbled upon pressure from the sheet P, to thus detect that the sheet P has reached the sheet passage sensor SP. Incidentally, the optical sensor can be rendered OFF from ON when the pivot arm SP1 is tumbled upon pressure from the sheet P, to thus detect that the sheet P has reached the sheet passage sensor SP.

The image forming unit 30 includes a scanner unit 40, four process cartridges 50, a holder 60, a transfer unit 70, and a fixing unit 100.

The scanner unit 40 is positioned at an upper internal portion of the main frame 10, and includes a laser emitting portion (not shown), a polygon mirror(not shown), lenses (not shown) and reflection mirrors (not shown). The scanner unit 40 is adapted to irradiate laser beam onto each surface of each photosensitive drum 51 at high speed scanning.

The process cartridges 50 are positioned above the sheet supply unit 20 and arrayed in frontward/rearward direction. Each process cartridge 50 includes the photosensitive drum 51, a developing roller 53, a charger (not shown), and a toner accommodation chamber (not shown).

The holder 60 is adapted to hold four process cartridges 50 at once. The holder 60 is movable through the front opening 10A in frontward/rearward direction by opening the front cover 11.

The transfer unit 70 is positioned between the sheet supply unit 20 and the four process cartridges 50, and includes a drive roller 71, a follower roller 72, a conveyer belt 73 and transfer rollers 74.

The drive roller 71 and the follower roller 72 extend in parallel to each other and are spaced away from each other in the frontward/rearward direction. The conveyer belt 73 such as an endless belt is looped over these rollers under tension. The transfer rollers 74 are positioned at an inner space of the conveyer belt 73 at positions in confrontation with the photosensitive drums 51 such that each transfer roller 74 and each corresponding photosensitive drum 51 nip the conveyer belt 73 therebetween.

The fixing unit 100 is positioned rearward of the four process cartridges 50 and the transfer unit 70. The fixing unit 100 will be described later in detail.

In the image forming unit 30, the charger is adapted to uniformly charge a surface of the rotating photosensitive drum 51. The scanner unit 40 is adapted to irradiate laser beam onto the surface of the photosensitive drum 51 to expose the surface to light, to thus form an electrostatic latent image on a basis of image data on the surface of the photosensitive drum 51.

The rotating developing roller 53 is adapted to supply toner onto the electrostatic latent image on the photosensitive drum 51 to form a toner image thereon. The sheet P supplied from the sheet supply unit 20 is moved past the photosensitive drum 51 and the transfer roller 74, so that the toner image on the photosensitive drum 51 is transferred onto the sheet P. The fixing unit 100 is adapted to thermally fix the toner image onto the sheet P.

The conveying unit 90 functions as a discharge mechanism for discharging the sheet P discharged out of the image forming unit 30 to an outside of the main frame 10. The conveying unit 90 also functions as a re-conveying mechanism for re-conveying the sheet formed with an image at a front surface (front side) to the image forming unit 30 for forming an image to a back surface (back side) of the sheet P after the sheet is turned upside down. More specifically, the conveying unit 90 includes conveyer rollers 91, second conveyer rollers 92, discharge rollers 93, a flapper 94, and re-conveyer rollers 95.

The first conveyer rollers 91 are positioned downstream of the fixing unit 100 and are adapted to convey the sheet P discharged from the fixing unit 100 toward the flapper 94. The second conveyer rollers 92 and the discharge rollers 93 are rotatable in forward and reverse directions. The forward rotations of these rollers 92, 93 convey the sheet P fed from the first conveyer rollers 91 toward a discharge tray 12 provided at an upper portion of the main frame 10. Reverse rotations of these rollers 92, 93 convey the sheet P toward an interior of the main frame 10.

The flapper 94 is pivotally movable between a first position indicated by a solid line and a second position indicated by a broken line. The flapper 94 allows the sheet P conveyed by the first conveyer rollers 91 to be directed toward the second conveyer rollers 92 positioned above the flapper 94 when the flapper 94 is at the first position. The flapper 94 allows the sheet P conveyed by the second conveyer rollers 92 to be directed toward the re-conveyer rollers 95 positioned below the flapper 94 when the flapper 94 is at the second position.

The plurality of re-conveyer rollers 95 are positioned below the sheet tray 21 and spaced away from each other in the frontward/rearward direction. The re-conveyer rollers 95 are adapted to convey the sheet P fed from the second conveyer rollers 92 toward front so as to supply the sheet P to the paper dust removing roller 22D.

In the conveying unit 90, when image forming operation is completed, the sheet P fed from the first conveyer rollers 91 is discharged out of the frame 10 and onto the discharge tray 12 by the forward rotation of the second conveyer rollers 92 and the discharge rollers 93. When image forming operation with respect to one surface of the sheet P is completed, and image forming operation with respect to an opposite surface of the sheet P is to be performed, the second conveyer rollers 92 and the discharge rollers 93 are reversely rotated before the entire sheet P is fully discharged outside the frame 10. As a result, the sheet P is again introduced into the frame 10, and is directed toward the re-conveyer rollers 95. Then, the sheet P is fed to the paper dust removing roller 22D by the re-conveyer rollers 95, and is fed to the image forming unit 30.

A first temperature sensor ST1 for detecting an ambient temperature inside the main frame 10 of the color printer 1 is provided at a front upper portion of the interior of the frame 10. Detection signals from the first temperature sensor ST1 and the sheet passage sensor SP are transmitted to a controller 300 described later.

Figure 2:
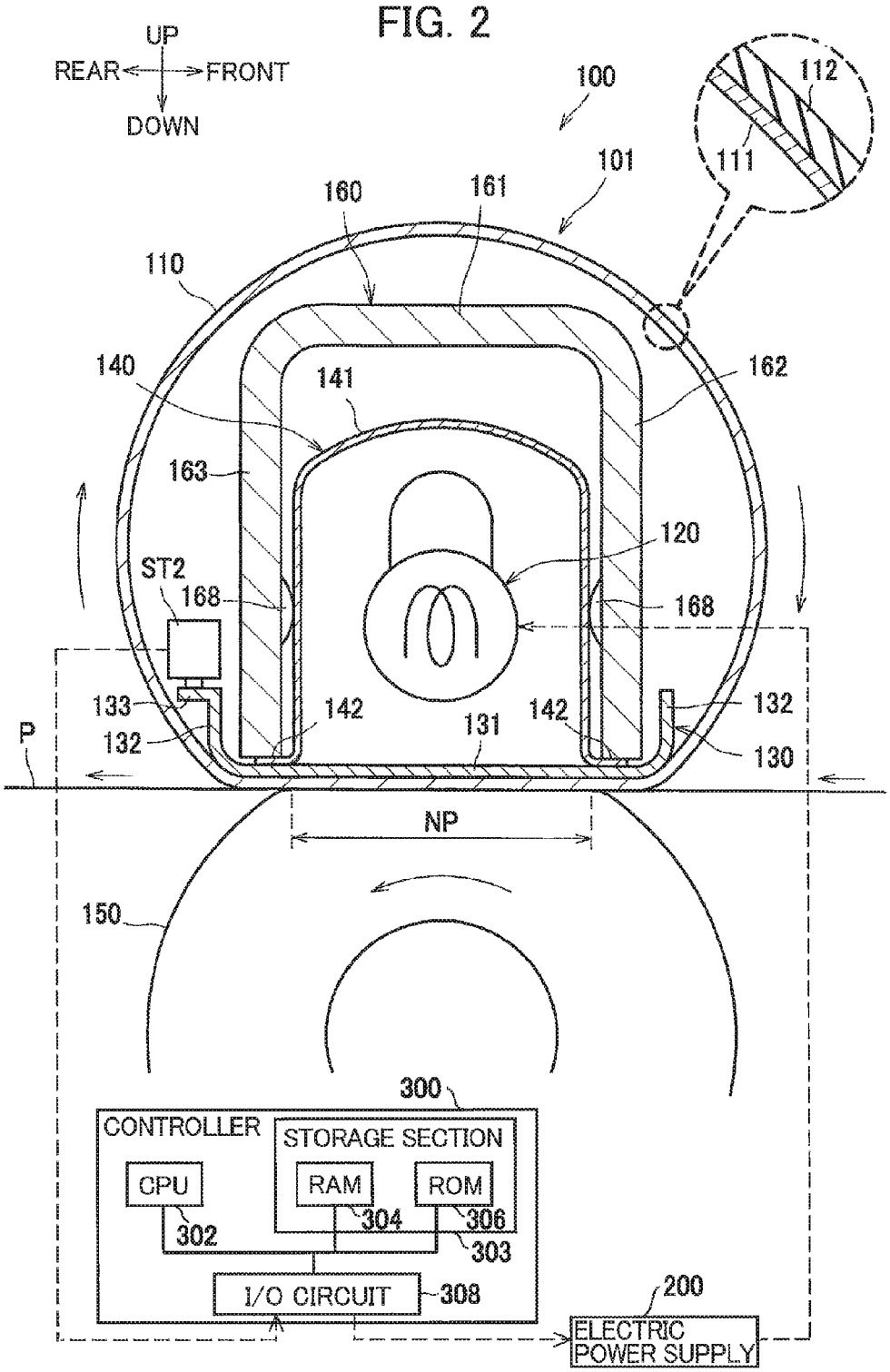
FIG. 2 is a cross-sectional view illustrating a fixing unit and a controller in the color printer of FIG. 1.

As shown in FIG. 2, the fixing unit 100 includes a heater 101 for heating the sheet P on which toner image has been formed, and a pressure roller 150 for providing a nip region NP in cooperation with the heater 101. The heater 101 includes an endless belt 110 (an example of a heating body), a halogen lamp 120 as an example of a heat source, a nip plate 130, a reflection plate 140, a stay 160, and a second temperature sensor ST2.

The endless belt 110 is a tubular cylindrical member having an axis extending in leftward/rightward direction. The endless belt 110 has heat resistivity and flexibility and is constituted by an inner metal layer 111 and an outer elastic layer 112.

The metal layer 111 is made from metal such as stainless steel. The metal layer 111 has an inner surface in contact with the nip plate 130.

An inner surface of the elastic layer 112 is in intimate contact with an outer surface of the inner metal layer 111, and is made from rubber such as silicone rubber that has both of peeling property and elasticity. The elastic layer 112 has an outer surface in contact with the pressure roller 150. A non-metallic separation layer made of non-metallic material such as fluororesin can be formed on the outer surface of the elastic layer 112 by fluorine coating.

The halogen lamp 120 is a heater for heating the endless belt 110 through the nip plate 130 to thus heat the toner on the sheet P. The halogen lamp 120 is positioned at the internal space of the endless belt 110 and is spaced away from the nip plate 130 by a predetermined distance. An electric power supply 200 is provided in the main frame 10. An electric power is supplied from the electric power supply 200 to the halogen lamp 120.

The nip plate 130 is adapted to provide the nip region NP between the endless belt 110 and the pressure roller 150 by nipping the endless belt 110 between the nip plate 130 and the pressure roller 150. The nip plate 130 is in a plate shape and is positioned below the halogen lamp 120. The nip plate 130 is adapted to receive radiant heat from the halogen lamp 120, and transmit the radiant heat to the toner on the sheet P through the endless belt 110.

The nip plate 130 is made of a plate such as an aluminum plate that has heat conductivity higher than the stay 160 (to be described later) that is made from steel. The nip plate 130 is formed by bending the plate into generally U-shape in cross-section. More specifically, the nip plate 130 includes a base portion 131 extending in frontward/rearward direction, folded portions 132 folded upward from a front end and rear end of the base portion 131, and an extension portion 133 extending rearward from an upper end of the rear folded portion 132.

A second temperature sensor ST2 is provided at the extension portion 133 for detecting temperature of the nip plate 130. The second temperature sensor ST2 can be a central thermistor for detecting temperature of a center portion of the nip plate 130 in leftward/rightward direction, or can be a side thermistor for detecting temperature of end portion of the nip plate 130 in leftward/rightward direction.

The temperature detected by the second temperature sensor ST2 is transmitted to the controller 300 provided in the main frame 10.

The reflection plate 140 is adapted to reflect radiant heat from the halogen lamp 120 toward the nip plate 130. The reflection plate 140 is disposed in the interior of the endless belt 110 and spaced away from the halogen lamp 120 by a predetermined interval to partly surround the halogen lamp 120.

The reflection plate 140 is made from a plate such as an aluminum plate that has high reflection ratio with respect to both of infrared ray and far infrared ray, and is curved into generally U-shape in cross-section. More specifically, the reflection plate 140 mainly includes a reflection portion 141 having curved shape (U-shape in cross-section), and flange portions 142 extending outward in frontward/rearward direction from each end of the reflection portion. Mirrored aluminum plate is available as the reflection plate 140 for enhancing heat reflection ratio.

The stay 160 is adapted to increase rigidity of the nip plate 130. To this effect, the stay 160 supports each end portion of the base portion 131 of the nip plate 130 in frontward/rearward direction through the flange portions 142 of the reflection plate 140. The stay 160 is positioned opposite to the pressure roller 150 with respect to the nip plate 130. The stay 160 includes an upper wall 161, a front wall 162 extending downward from a front end of the upper wall 161, and a rear wall 163 extending downward from a rear end of the upper wall 161. Thus, the stay 160 is generally U-shaped in cross-section covering the reflection plate 140.

A protrusion 168 protrudes toward the reflection plate 140 from an inner surface of the front wall 162. Another protrusion 168 protrudes toward the reflection plate 140 from an inner surface of the rear wall 163 for holding the reflection plate 140. The stay 160 is made of a plate such as a steel plate that has relatively high rigidity, and is formed by bending the plate into generally U-shape in cross-section.

The pressure roller 150 is resiliently deformable, and is positioned below the nip plate 130. The pressure roller 150 provides the nip region NP in cooperation with the endless belt 110 when nipping the endless belt 110 between the nip plate 130 and the resiliently deformed pressure roller 150.

The pressure roller 150 is adapted to be rotated by a driving force from a motor (not shown) provided in the main frame 10. Rotation of the pressure roller 150 causes the endless belt 110 to circularly move because of the frictional force relative to the sheet P or to the endless belt 110

Details in the configuration of the controller 300 are shown in FIG. 2. As shown in FIG. 2, the controller 300 includes: a CPU 302; a storage section 303 having a RAM 304, a ROM 306, and the like; and an input/output circuit 308. The controller 300 controls the entire part of the color printer 1. For example, the controller 300 controls the electric power supply 200, sheet supply unit 20, image forming unit 30, and sheet conveying unit 90, by performing arithmetic operation based on: inputs from the sheet passage sensor SP, first temperature sensor ST1, and second temperature sensor ST2; contents of the print instruction; and data and programs stored in the ROM 306. More specifically, the controller 300 executes a continuous printing process to control the sheet supply unit 20, image forming unit 30, and sheet conveying unit 90 so that sheets P are continuously conveyed in succession and images are formed on the conveyed sheets P in succession. It is apparent from FIG. 1 that the controller 300 receives inputs from the first temperature sensor ST1 and the sheet passage sensor SP, and controls the fixing unit 100 and the pick-up roller 22A. It is also apparent from FIG. 2 that the controller 300 receives inputs from the second temperature sensor ST2, and controls the electric power supply 200. It is noted, however, that the controller 300 receives inputs from other various elements in the color printer 1, and controls other various elements in the color printer 1. The programs stored in the ROM 306 contain: programs for executing the flowcharts shown in FIGS. 4 and 5 to be described later; and programs for executing the continuous printing process to continuously convey sheets in succession and to form images on the sheets in succession as will be described later with reference to FIG. 6.

Specifically, the controller 300 has a function of executing a high-output tendency control (an example of a second output process) at a prescribed timing. The prescribed timing is such a timing that is prior to the timing at which the sheet P reaches the heater 101. More specifically, the prescribed timing is such a timing that is prior to the timing at which the sheet P enters the nip region NP that is formed between the heater 101 and the pressure roller 150. The controller 300 executes the high-output tendency control for a prescribed time period from the prescribed timing. During the high-output tendency control, the controller 300 controls the electric power supply 200 such that the output of the electric power supply 200 has a tendency to become higher than an output value that the electric power supply 200 has outputted before the prescribed timing (immediately preceding output value). The high-output tendency control is for controlling the electric power supply 200 such that the output of the halogen lamp 120 is apt to become higher than that in a low-output tendency control (an example of a first output process) under the same conditions (temperature, usage condition, etc.) While executing the continuous printing control to continuously form images on a plurality of sheets P in succession, the controller 300 performs the high-output tendency control in association with a timing at which each sheet P is fed to the heater 101.

While executing the continuous printing control, the controller 300 executes the high-output tendency control repeatedly such that a succeeding high-output tendency control is executed after a preceding high-output tendency control is, and executes the low-output tendency control during an entire period between a preceding high-output tendency control period, in which the preceding high-output tendency control is executed, and a succeeding high-output tendency control period, in which the succeeding high-output tendency control is executed. In other words, the controller 300 executes the low-output tendency control during an entire length of a period between each two successive high-output execution periods, wherein the high-output tendency control is executed during each high-output execution period. The low-output tendency control is for controlling the electric power supply 200 to output power such that an output of the electric power supply 200 during the low-output tendency control has a tendency to become lower than the output of the electric power supply 200 during the high-output tendency control. The controller 300 executes the low-output tendency control in correspondence with a gap or space between each two successive sheets P.

That is, while conveying the plurality of sheets P in the continuous printing process, the controller 300 performs the high-output tendency control before each sheet P enters the nip region NP. This ensures that before the sheet P enters the nip region NP, the heater 101 has been heated to store heat, and that the stored heat has been transmitted to the elastic layer 112 of the endless belt 110 at the time when the sheet P enters the nip region NP. Further, the controller 300 performs the low-output tendency control at a timing corresponding to a time interval, in which no recording sheet P exists in the nip region NP. This ensures that heat is not accumulated in the heater 101 in vain after one sheet P exits from the nip region NP and before the next sheet enters the nip region NP.

Specifically, the controller 300 performs a feedback control on the electric power supply 200 so that the temperature detected by the second temperature sensor ST2 will become equal to a predetermined target temperature TE. More specifically, the controller 300 executes the low-output tendency control by setting the target temperature TE to a first target temperature TE1, and executes the high-output tendency control by setting the target temperature TE to a second target temperature TE2. The second target temperature TE2 is higher than the first target temperature TE1.

When performing the high-output tendency control for such a sheet P whose front surface (front side) has been formed with an image but whose back surface (back side) has not been formed with an image (hereinafter, referred to also as "front surface fixing time"), the controller 300 controls the electric power supply 200 so that the amount of heat generated by the halogen lamp 120 becomes a first heat amount. When performing the high-output tendency control for such a sheet P whose both of front and back surfaces have been formed with images (hereinafter, referred to also as "back surface fixing time"), the controller 300 controls the electric power supply 200 so that the amount of heat generated by the halogen lamp 120 becomes a second heat amount that is smaller than the first heat amount.

Specifically, in double-sided printing, the controller 300 differentiates the length of the above-mentioned prescribed time period (time period during which the high-output tendency control is performed) between the front surface fixing time and the back surface fixing time, to thereby differentiate the amount of heat generated by the halogen lamp 120 between the front surface fixing time and the back surface fixing time. More in detail, the controller 300 differentiates the length of the prescribed time period by differentiating the start timing of the high-output tendency control relative to the detection timing of the sheet passage sensor SP. Specifically, the controller 300 sets the length of a start period (first timer threshold value Tth1 and second timer threshold value Tth2 to be described later), which is a time period from when the output of the sheet passage sensor SP is switched from OFF to ON to when the high-output tendency control is started, to a first start period a at the front surface fixing time and to a second start period β at the back surface fixing time so that the length of the second start period β is longer than the length of the first start period α.

The termination timing of the high-output tendency control relative to the detection timing of the sheet passage sensor SP is fixed for sheets P of a prescribed type. In other words, an end period τ, which is a time period from when the output of the sheet passage sensor SP is switched from OFF to ON to when the high-output tendency control is ended, is set to a constant value for each type of the sheet P. That is, the end period τ is set to a plurality of values according to a plurality of different types of sheet P.

Thus, the time period during which the high-output tendency control is performed at the front surface fixing time is a value (τ−α), and the time period during which the high-output tendency control is performed at the back surface fixing time is a value (τ−β). The value (τ−β) is shorter than the value (τ−α).

The controller 300 sets the first start period α and second start period β so that the minimum lengths of the prescribed time periods (τ−α) and (τ−β) are longer than a length of time that it takes for the endless belt 110 to make one turn and so that the maximum lengths of the prescribed time periods (τ−α) and (τ−β) are shorter than a length of time that it takes for a single sheet P to pass through the nip region NP of the heater 101. Thus, the lengths of the prescribed time periods (τ−α) and (τ−β) are set within such a range that is longer than or equal to the length of time that it takes for the endless belt 110 to make one turn and that is shorter than or equal to the length of time that it takes for a single sheet P to pass through the nip region NP.

Figure 3:
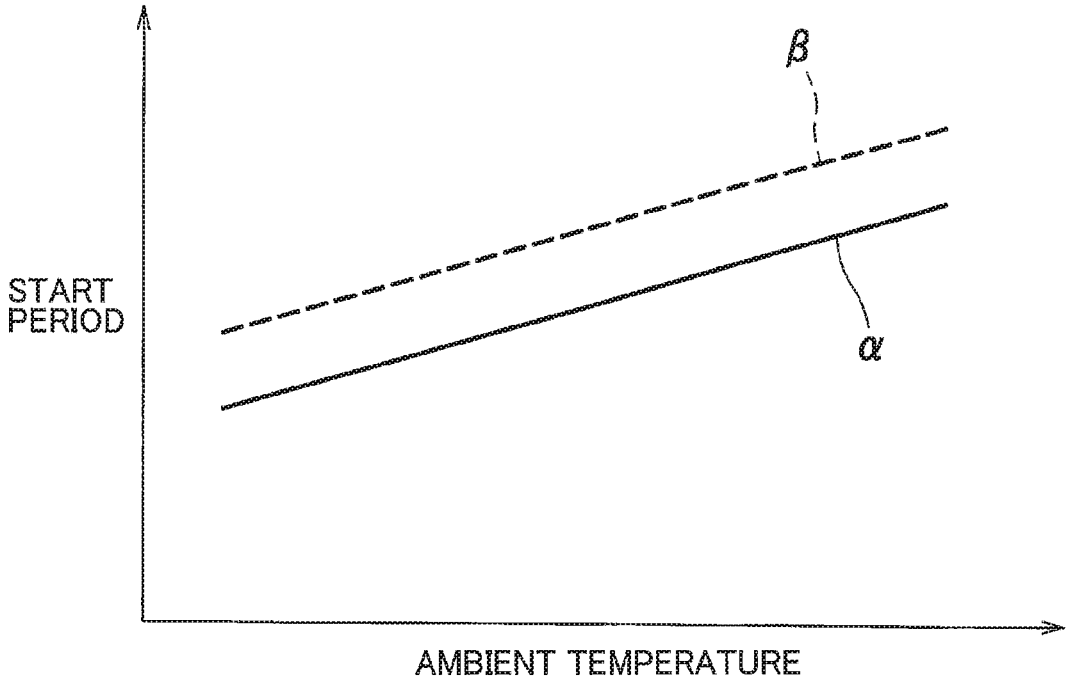
FIG. 3 is a graphical representation showing a relationship between the value of the ambient temperature and the lengths of start periods.

Further, the controller 300 sets the first start period α and second start period β so that the amount of heat generated by the halogen lamp 120 under the high-output tendency control becomes smaller as the ambient temperature is higher. Specifically, as illustrated in FIG. 3, the first start period α and second start period β are set longer as the ambient temperature becomes higher. In other words, the lengths of the prescribed time periods (τ−α) and (τ−β) become shorter as the ambient temperature becomes higher. For example, a map or a function as illustrated in FIG. 3 is stored in the storage section 303 (RAM 304 or ROM 306, for example). The controller 300 sets the first start period α and second start period β based on the map or function stored in the storage section 303 and the ambient temperature detected by the first temperature sensor ST1.

Figure 6:
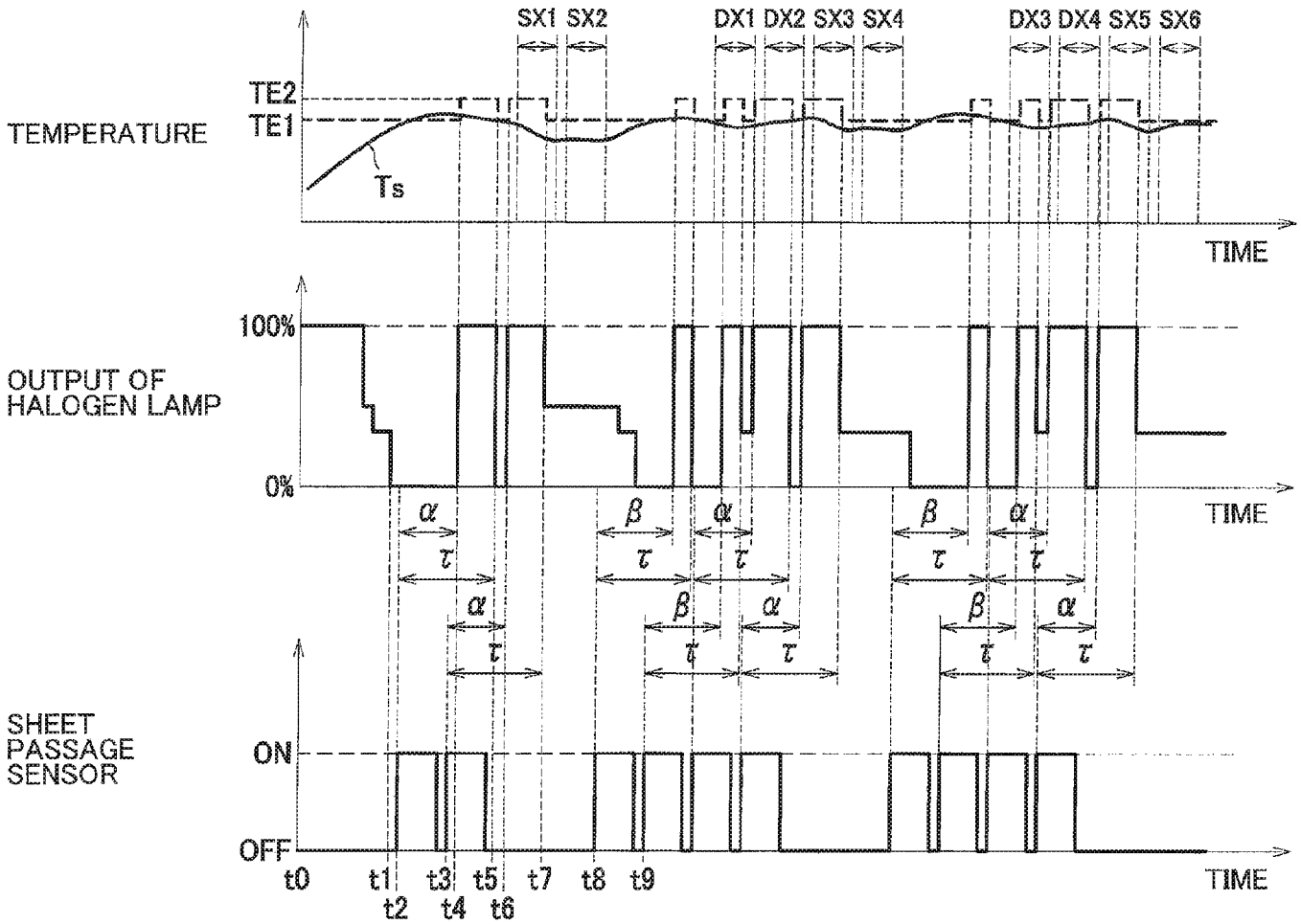
FIG. 6 is a timing chart illustrating how each parameter varies while double-sided printing is continuously executed on a plurality of sheets according to the embodiment.

The controller 300 performs the double-sided printing such that front-surface printing (transfer and thermal fixing of a toner image on the front surface) is executed on two sheets P successively and then back-surface printing (transfer and thermal fixing of a toner image on the back surface) is executed on the two sheets P successively. That is, the controller 300 performs the front-surface printing for two sheets and the back-surface printing for two sheets, in alternation. More in detail, as illustrated in FIG. 6, assume that the front surfaces of a plurality of sheets P are SX1, SX2, . . . in the printing order, and the back surfaces thereof are DX1, DX2, . . . . In such a case, first, the front surfaces SX1 and SX2 of the first and second sheets P are subjected to printing sequentially. After that, the back surfaces DX1 and DX2 of the first and second sheets P are subjected to printing sequentially, and then the front surfaces SX3 and SX4 of the third and fourth sheets P are subjected to printing sequentially. After that, the back surfaces DX3 and DX4 of the third and fourth sheets P are subjected to printing sequentially, and then the front surfaces SX5 and SX6 of the fifth and sixth sheets P are subjected to printing sequentially. Thereafter, the same operation is repeated.

Operations of the controller 300 will be described in detail below.

Upon receipt of a print instruction, the controller 300 starts executing a printing process. At the same time, the controller 300 starts executing the processes of FIGS. 4 and 5.

Figure 8:
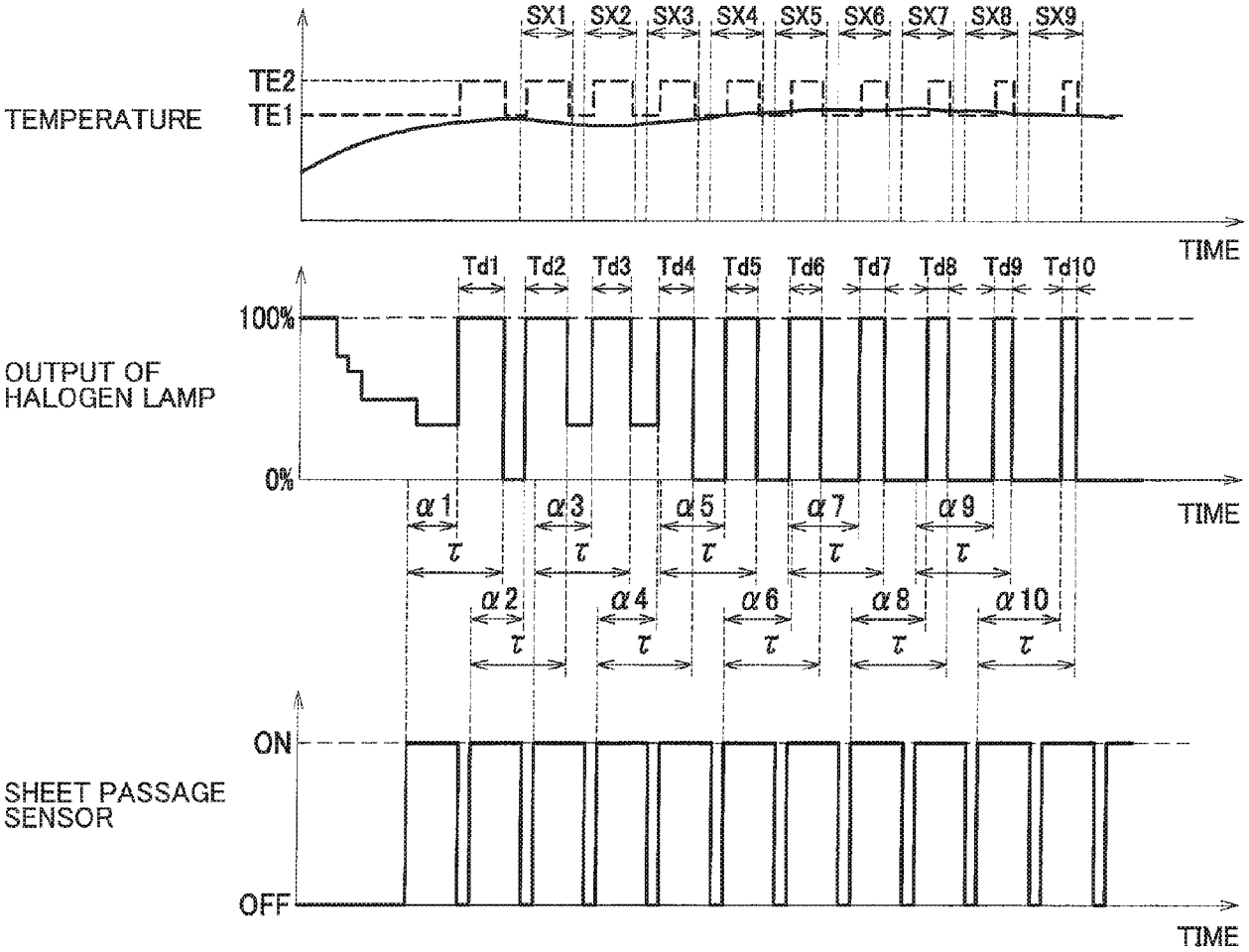
FIG. 8 is a timing chart illustrating how each parameter varies while single-sided printing is continuously executed on a plurality of sheets according to the modification.

In the printing process, the controller 300 starts printing an image on a sheet by controlling the sheet-conveying mechanism 22, image forming unit 30, and sheet conveying unit 90. Especially when the print instruction indicates that a plurality of sheets should be printed with images, the controller 300 performs the continuous printing process, in which the sheet-conveying mechanism 22 and sheet conveying unit 90 continuously convey sheets in succession and the image forming unit 30 forms images onto the sheets in succession. More specifically, when the double-sided continuous printing is executed, images are formed on the surfaces SX1, SX2, DX1, DX2, SX3, SX4, DX3, DX4, . . . of the sheets P in this order as illustrated in FIG. 6. When the single-sided continuous printing is executed, images are formed on the front surfaces SX1, SX2, SX3, SX4, . . . of the sheets P in this order similarly as illustrated in FIG. 8. While performing the continuous printing process, the controller 300 repeatedly sets the first timer threshold value Tth1 or second timer threshold value Tth2 by executing the process of FIG. 4, and controls the output of the halogen lamp 120 by executing the process of FIG. 5.

The process of FIG. 4 will be described below in greater detail.

Figure 4:
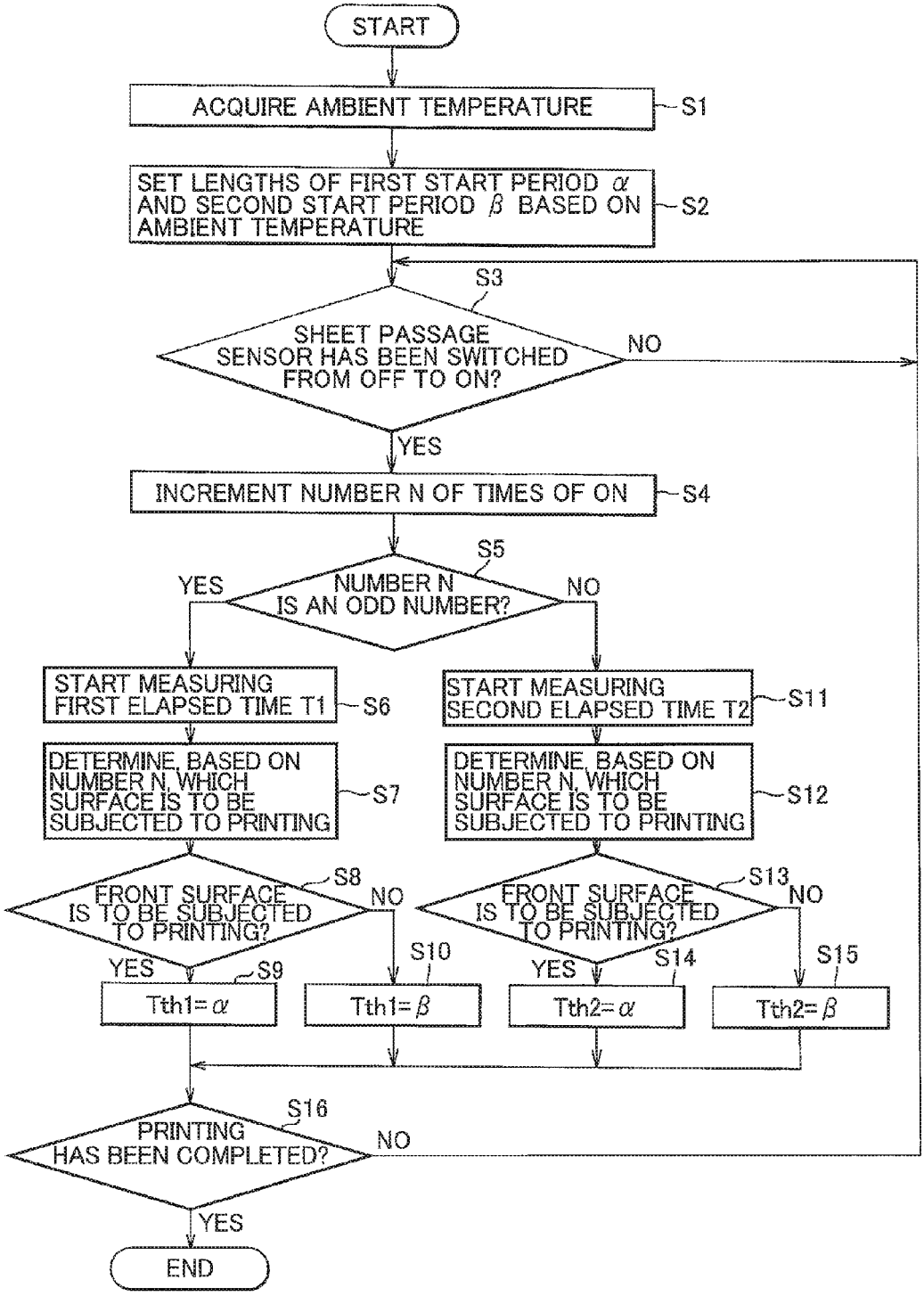
FIG. 4 is a flowchart illustrating a process for setting threshold values according to the embodiment.

When receiving the print instruction, the controller 300 starts executing the process of FIG. 4. When the process of FIG. 4 is started, first in S1, the controller 300 acquires an ambient temperature from the first temperature sensor ST1. Next, in S2, the controller 300 sets the lengths of the first start period α and second start period β based on the ambient temperature and the map illustrated in FIG. 3.

Then, the controller 300 determines in S3 whether or not the sheet passage sensor SP has been switched from OFF to ON. While the sheet passage sensor SP has not been switched from OFF to ON (No in S3), the process repeatedly executes the process of S3 until a sheet P reaches the sheet passage sensor SP to switch the sheet passage sensor SP to ON (Yes in S3).

When the sheet passage sensor SP is switched from OFF to ON (Yes in S3), in S4, the controller 300 increments by one (1) the number N of times of "ON" which is the number of times that the sheet passage sensor SP has been turned ON. Then, in S5, the controller 300 determines whether or not the number N of times of "ON" is an odd number.

When the number N of times of "ON" is an odd number (Yes in S4), it is known that an odd-numbered sheet has arrived at the sheet passage sensor SP, and therefore the process proceeds to S6, in which the controller 300 activates a first timer (not shown) to start measuring a first elapsed time T1. The first elapsed time T1 is an elapsed time from when the sheet passage sensor SP was switched from OFF to ON due to arrival of the odd-numbered sheet P at the sheet passage sensor SP. Then, in S7, the controller 300 determines, based on the contents of the print instruction and the number N of times of "ON", which surface (front or back surface) of the sheet P, which has arrived at the sheet passage sensor SP, is to be subjected to printing (thermal fixing).

Specifically, when the controller 300 determines based on the contents of the print instruction that the current print operation is single-sided printing, the controller 300 determines that the front surface is to be subjected to printing, irrespective of the number N of times of "ON". On the other hand, when the controller 300 determines based on the contents of the print instruction that the current print operation is double-sided printing, the controller 300 determines that the front surface is to be subjected to printing when the number N of times of "ON" is 1, 2, 5, 6, 9, 10, . . . , and determines that the back surface is to be subjected to printing when the number N of times of "ON" is 3, 4, 7, 8, 11, 12, . . . .

Next, in S8, the controller 300 determines whether or not the determination results in S7 indicate that the front surface is to be subjected to printing. When the determination results in S7 indicate that the front surface is to be subjected to printing (Yes in S8), the controller 300 sets in S9 the first start period $\alpha$ as a first timer threshold value Tth1, which is a start period of the high-output tendency control.

On the other hand, when the determination results in step S7 indicate that the back surface is to be subjected to printing (No in S8), the controller 300 sets in S10 the second start period $\beta$ as the first timer threshold value Tth1.

On the other hand, when the number N of times of "ON" is an even number (No in S5), it is known that an even-numbered sheet P has arrived at the sheet passage sensor SP. Therefore, the process proceeds to S11, in which the controller 300 activates a second timer (not shown) to start measuring a second elapsed time T2. The second elapsed time T2 is an elapsed time from when the sheet passage sensor SP was switched from OFF to ON due to arrival of the even-numbered sheet P at the sheet passage sensor SP. Next, in S12, the controller 300 performs the same processing as the process of S7. Specifically, the controller 300 determines, based on the contents of the print instruction and the number N of times of "ON", which surface (front or back surface) of the sheet P having arrived at the sheet passage sensor SP is to be subjected to printing.

Next, in S13, the controller 300 determines whether or not the determination results in S12 indicate that the front surface is to be subjected to printing. When the determination results in S12 indicate that the front surface is to be subjected to printing (Yes in S13), in S14, the controller 300 sets the first start period $\alpha$ as a second timer threshold value Tth2, which is a start period of the high-output tendency control.

On the other hand, when the determination results in S12 indicate that the back surface is to be subjected to printing (No in S13), the controller 300 sets in S15 the second start period $\beta$ as the second timer threshold value Tth2. After executing the process of S9, S10, S14, or S15, the controller 300 determines in S16 whether or not the print control has been completed on sheets P of the total print number specified in the print instruction. When the print control has not yet been completed (No in S16), the process returns to S3. On the other hand, when the print control has been completed (Yes in S16), the controller 300 ends the process of FIG. 4.

Figure 5:
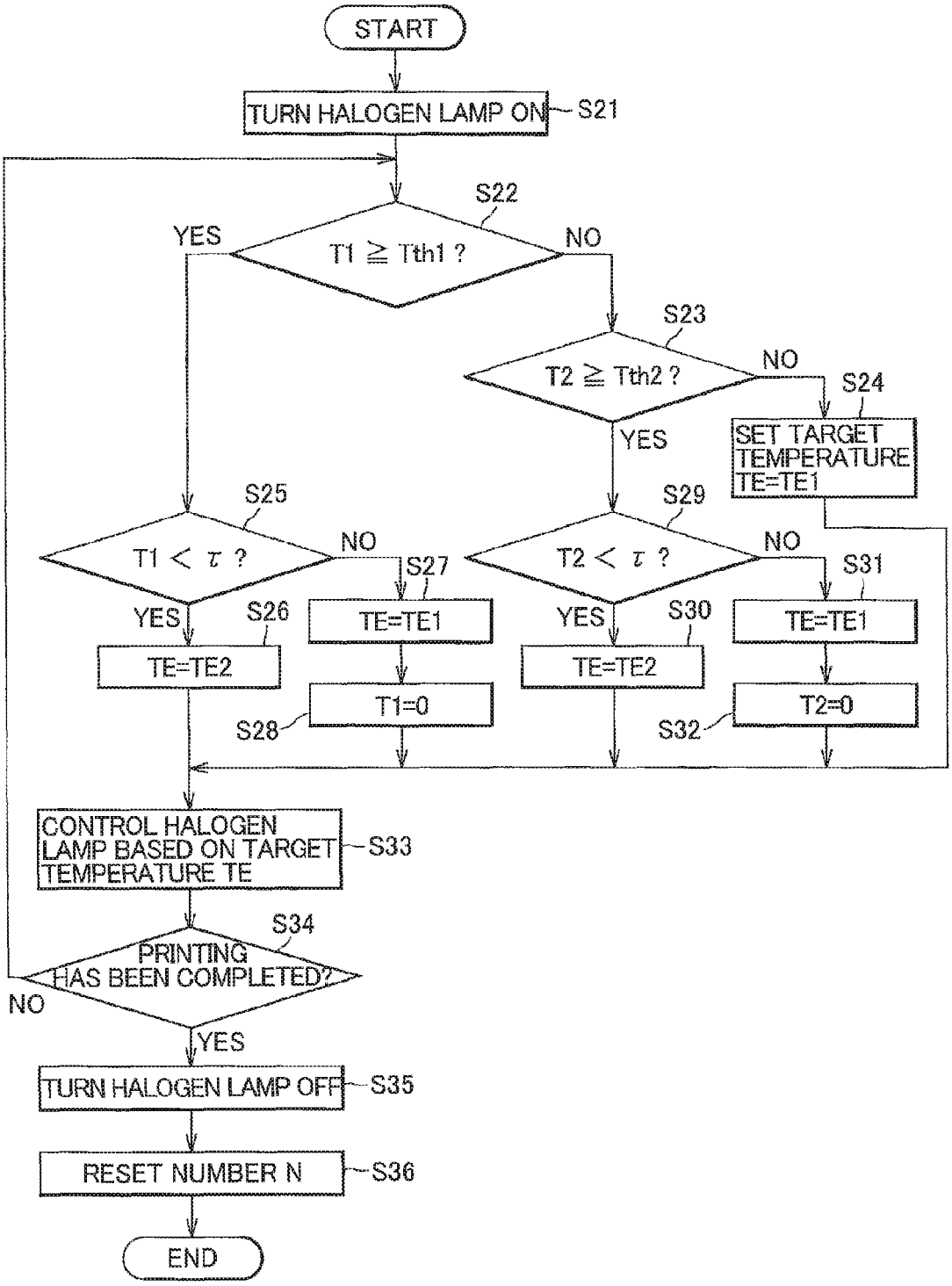
FIG. 5 is a flowchart illustrating a process for controlling a halogen lamp according to the embodiment.

The controller 300 also starts executing the process of FIG. 5 upon receipt of the print instruction. When the process of FIG. 5 is started, first in S21, the controller 300 turns ON the halogen lamp 120. Next, the controller 300 determines in S22 whether the first elapsed time T1 has become longer than or equal to the first timer threshold value Tth1.

When the first elapsed time T1 is shorter than the first timer threshold value Tth1 (No in S22), the controller 300 determines in S23 whether the second elapsed time T2 has become longer than or equal to the second timer threshold value Tth2. When the second elapsed time T2 is shorter than the second timer threshold value Tth2 (No in S23), the process proceeds to S24, in which the controller 300 sets the first target temperature TE1 as the target temperature TE.

On the other hand, when the first elapsed time T1 has become longer than or equal to the first timer threshold value Tth1 (Yes in S22), the controller 300 determines in S25 whether or not the first elapsed time T1 is shorter than the end period $\tau$. When the first elapsed time T1 is shorter than the end period $\tau$ (Yes in S25), the process proceeds to S26, in which the controller 300 sets, as the target temperature TE, the second target temperature TE2 that is higher than the first target temperature TEL When the first elapsed time T1 becomes longer than or equal to the end period $\tau$ (No in S25), the controller 300 sets the first target temperature TE1 as the target temperature TE in S27, and resets the first elapsed time T1 to zero (0) in S28.

When the second elapsed time T2 has become longer than or equal to the second timer threshold value Tth2 (Yes in step S23), the controller 300 determines in S29 whether or not the second elapsed time T2 is shorter than the end period $\tau$. When the second elapsed time T2 is shorter than the end period $\tau$ (Yes in S29), the process proceeds to S30 in which the controller 300 sets the second target temperature TE2 as the target temperature TE. When the second elapsed time T2 has become longer than or equal to the end period $\tau$ (No in S29), the controller 300 sets the first target temperature TE1 as the target temperature TE in S31, and rests the second elapsed time T2 to zero (0) in S32.

After executing the process of S24, S26, S28, S30, or S32, the process proceeds to S33, in which the controller 300 controls the output of the halogen lamp 120 on the basis of the measurement results of the second temperature sensor ST2 and the target temperature TE. That is, in S33, the controller 300 performs a feedback control on the output of the halogen lamp 120 while referring to the target temperature TE so that the temperature detected by the second temperature sensor ST2 will become equal to the target temperature TE.

After executing the process of S33, the controller 300 determines in S34 whether or not the print control has been completed on sheets P of the total print number specified in the print instruction. When print control has not yet been completed (No in S34), the controller 300 returns to the process of S22.

On the other hand, when the print control has been completed (Yes in S34), the controller 300 turns OFF the halogen lamp 120 in S35, resets the number N of times of "ON" to zero (0) in S36, and ends the process of FIG. 5.

Next will be described how the values of various parameters change while six or more sheets P are continuously subjected to double-sided printing.

As illustrated in FIG. 6, when a print instruction is received (time t0), the controller 300 turns ON the halogen lamp 120. At this time, the first and second timers have not yet been activated. Accordingly, the process in FIG. 5 proceeds such that the determination in S22 becomes negative, the determination in S23 becomes negative, and the target temperature TE is set to the first target temperature TE1 in S24. That is, upon receipt of the print instruction, the controller 300 first executes the low-output tendency control.

If the temperature Ts detected by the second temperature sensor ST2 at this time is lower than the first target temperature TE1 and the difference between the detected temperature Ts and the first target temperature TE1 is greater than or equal to a first predetermined value, the controller 300 increases the output value of the halogen lamp 120 up to substantially 100%. For example, as the output value, the controller 300 controls a duty ratio of the halogen lamp 120, that is, the lighting frequency of the halogen lamp 120 per unit time. As the temperature Ts approaches the first target temperature TE1, the controller 300 gradually decreases the output of the halogen lamp 120. When the difference between the temperature Ts and the first target temperature TE1 becomes less than or equal to a second predetermined value which is smaller than the first predetermined value (time t1), the controller 300 turns OFF the halogen lamp 120.

Thereafter, when the first sheet P, whose front surface is to be subjected to printing, arrives at the sheet passage sensor SP and the sheet passage sensor SP is switched from OFF to ON (time t2), the controller 300 sets N to one (1) in S4 of FIG. 4, and the determination results in S5 become affirmative ("Yes"). Subsequently, the controller 300 starts measuring the first elapsed time T1 in S6, determines that the front surface is to be subjected to printing in S7 and S8, and sets the first start period α as the first timer threshold value Tth1 in S9.

Thereafter, when the second sheet P, whose front surface is to be subjected to printing, arrives at the sheet passage sensor SP and the sheet passage sensor SP is switched from OFF to ON (time t3), the controller 300 sets N to two (2) in S4, and the determination results in S5 become negative ("No"). Subsequently, the controller 300 starts measuring the second elapsed time T2 in S11, determines that the front surface is to be subjected to printing in S12 and S13, and sets the first start period α as the second timer threshold value Tth2 in S14.

Thereafter, when the first start period α has elapsed from the time t2 (time t4), that is, when the first elapsed time period T1 becomes longer than or equal to the first timer threshold value Tth1 (Yes in S22), the controller 300 changes the target temperature TE from the first target temperature TE1 to the second target temperature TE2 in S26, thereby starting execution of the high-output tendency control. That is, at the time t4, the controller 300 increases the output value of the halogen lamp 120 from 0% to 100%. As a result, at the time t4, the output value of the halogen lamp 120 becomes greater than the output value of the halogen lamp 120 immediately prior to the time t4.

When the end period τ has elapsed from the time t2 (time t5), the controller 300 changes the target temperature TE from the second target temperature TE2 back to the first target temperature TE1 in S27, thereby terminating the high-output tendency control and starting execution of the low-output tendency control. If the temperature Ts detected at this time has a value close to the first target temperature TE1, the controller 300 turns OFF the halogen lamp 120 as shown in FIG. 6. Further, the controller 300 resets the first elapsed time T1 to zero (0) in S28.

As shown in FIG. 6, the period of time, during which the output of the halogen lamp 120 is set 100% under the first high-output tendency control, is displaced in time from the period of time, during which the front surface SX1 of the first sheet P passes through the nip region NP (illustrated in the temperature graph in FIG. 6). That is, before the front surface SX1 enters the nip region NP, the high-output tendency control is executed on the halogen lamp 120 to heat the heater 101 and heat is accumulated in the heater 101. The accumulated heat is transmitted to the front surface SX1 when the front surface SX1 passes through the nip region NP.

Thereafter, when the first start period α has elapsed from the time t3 (time t6), that is, when the second elapsed time T2 becomes longer than or equal to the second timer threshold value Tth2 (Yes in S23), the controller 300 starts executing the high-output tendency control in S30. When the end period τ has elapsed from the time t3 (time t7), the controller 300 terminates the high-output tendency control and starts executing the low-output tendency control in S31. At this time, the controller 300 resets the second elapsed time T2 to zero (0) in S32.

Similarly as described above, the period of time, during which the second high-output tendency control is performed, is displaced in time from the period of time, during which the front surface SX2 passes through the nip region NP. Accordingly, the heat accumulated in the heater 101 under the second high-output tendency control is satisfactorily transmitted to the front surface SX2 when the front surface SX2 passes through the nip region NP.

Thereafter, when the first sheet P whose back surface DX2 is to be subjected to printing is detected by the sheet passage sensor SP (time t8), the controller 300 sets N to three (3) in S4, and the determination results in S5 become affirmative ("Yes"). Subsequently, the controller 300 starts measuring the first elapsed time T1 in S6, determines that the back surface is to be subjected to printing in S7 and S8, and sets the second start period β, which is longer than the first start period α, as the first timer threshold value Tth1 in S10.

Thereafter, when the second sheet P whose back surface DX2 is to be subjected to printing is detected by the sheet passage sensor SP (time t9), the controller 300 sets N to four (4) in S4 and the determination results in S5 become negative ("No"). Subsequently, the controller 300 starts measuring the second elapsed time T2 in S11, determines that the back surface is to be subjected to printing in S12 and S13, and sets the second start period β as the second timer threshold value Tth2 in S15.

Similarly as in the case of the front surface SX1, when the second start period β has elapsed from the time t8, the controller 300 starts performing the high-output tendency control. The controller 300 terminates the high-output tendency control after elapse of the end period τ from the time t8. Further, similarly as in the case of the front surface SX2, when the second start period β has elapsed from the time t9, the controller 300 starts performing the high-output tendency control. The controller 300 terminates the high-output tendency control after elapse of the end period τ from the time t9.

Then, the controller 300 performs the control the same as the above-described control onto the front surfaces SX3, SX4, . . . and back surfaces DX3, DX4, . . . . As a result, the high-output tendency control is performed to each of the front and back surfaces of each sheet P, and the low-output tendency control is performed to the gap or space between each two successive sheets P. Similarly to the double-sided printing described above, also in the case of single-sided printing, the high-output tendency control is performed every time each sheet P is fed to the nip region NP. Specifically, in single-sided printing, the controller 300 always determines in S7 and S12 of FIG. 4 that the front surface is to be subjected to printing.

According to the embodiment described above, the following advantages can be obtained.

While a plurality of sheets are being continuously printed with images in succession, the high-output tendency control is performed at a timing in association with a timing when each sheet P is fed to the heater 101. Thus, heat of a sufficiently large amount has been accumulated in the heater 101 through the high-output tendency control until each sheet P in a cooled state reaches the heater 101 through the continuous printing process. Therefore, even if heat is taken from the heater 101 by the cooled sheet P, the temperature of the heater 101 can be prevented from excessively lowering, which can in turn suppress occurrence of insufficient fixing.

To perform the high-output tendency control before the sheet P reaches the heater 101, is particularly effective in such a configuration that the heater 101 is provided with the endless belt 110 having the elastic layer 112. The elastic layer 112 is liable not to conduct heat. It takes a relatively long period of time that heat is transmitted from the nip plate 130 to the outer surface of the elastic layer 112. Accordingly, by having performed the high-output tendency control on the halogen lamp 120 before a sheet P reaches the heater 101, the sheet P can be satisfactorily thermally fixed by the outer surface of the elastic layer 112 when the sheet P reaches the heater 101.

Further, the low-output tendency control is performed in correspondence with the gap or space between each two successive sheets P. In other words, the low-output tendency control is performed at a timing corresponding to a time interval between two successive timings, at which each two successive sheets P are fed to the nip region NP. Thus, in a situation where no sheet P is present in the nip region NP, the pressure roller 150 can be prevented from being heated in vain by heat stored in the heater 101.

When the high-output tendency control is performed on such a sheet P whose front surface has been formed with an image but whose back surface has not been formed with an image (front surface fixing time), the halogen lamp 120 is controlled under the high-output tendency control to generate heat of a first amount. When the high-output tendency control is performed on such a sheet P whose both of front and back surfaces have been formed with images (back surface fixing time), the halogen lamp 120 is controlled under the high-output tendency control to generate heat of a second amount that is smaller than the first amount. Thus, the sheet P, whose both of front and back surfaces have been formed with images, can be prevented from being heated excessively. The sheet P that is formed with images on both of front and back surfaces thereof has already been heated by the heater 101 at the time of thermally fixing the image on the front surface. By reducing the amount of heat generated for fixing the image on the back surface, the sheet P can be prevented from being heated excessively.

When the ambient temperature is relatively high, the temperature of the sheet P housed in the supply tray 21 is also relatively high. Excessive heating can be prevented by controlling the halogen lamp 120 under the high-output tendency control such that the amount of heat generated by the halogen lamp 120 decreases as the ambient temperature increases.

The start timing of the high-output tendency control is changed relative to the detection timing when the sheet P is detected by the sheet passage sensor SP, thereby changing the length of the prescribed time period and the amount of generated heat accordingly. The end timing of the high-output tendency control can be set fixed relative to the detection timing when the sheet P is detected by the sheet passage sensor SP. Thus, it is ensured that the sheet P enters the nip region NP at a timing when heat accumulated in the heater 101 under the high-output tendency control is transmitted to the outer peripheral surface of the endless belt 110, whereby the sheet P can be satisfactorily subjected to thermal fixing.

The maximum lengths of the prescribed time periods ($\tau-\alpha$) and ($\tau-\beta$), during which the high-output tendency control is performed, are shorter than the time period that it takes one sheet P to be conveyed through the nip region NP. Execution time periods, during which the high-output tendency control is executed on successive sheets P, can be prevented from overlapping each other, thereby suppressing power from being outputted in vain during the interval between the timings when each two successive sheets P are conveyed through the nip region NP.

In addition, the minimum lengths of the prescribed time periods ($\tau-\alpha$) and ($\tau-\beta$), during which the high-output tendency control is performed, are longer than the length of time that it takes for the endless belt 110 to make one turn. The entire length of the endless belt 110 can be uniformly heated by the endless belt 110.

Next will be described a modification of the present embodiment with reference to FIGS. 7 and 8. In the following description, the same reference numerals are given to substantially the same components and control steps, and descriptions thereof will be omitted.

In the above-described embodiment, during the time period from start to end of the print control, the lengths of the first start period $\alpha$ and second start period $\beta$ set in S2 are maintained unchanged. In other words, during the time period from start to end of the print control, the lengths of the prescribed time periods ($\tau-\alpha$) and ($\tau-\beta$) are maintained unchanged. However, the lengths of the prescribed time periods ($\tau-\alpha$) and ($\tau-\beta$) may be changed during the time period from start to end of the print control. For example, in this modification, during the time period from start to end of the print control, the lengths of the first start period $\alpha$ and second start period $\beta$ are gradually increased in accordance with an increase in the total number of prints. In other words, during the time period from start to end of the print control, the lengths of the prescribed time periods ($\tau-\alpha$) and ($\tau-\beta$) are gradually decreased in accordance with the increase in the number of prints. According to this modification, the amount of heat generated by the halogen lamp 120 under the high-output tendency control decreases as the number of prints increases during the time period from start to end of the print control.

Figure 7:
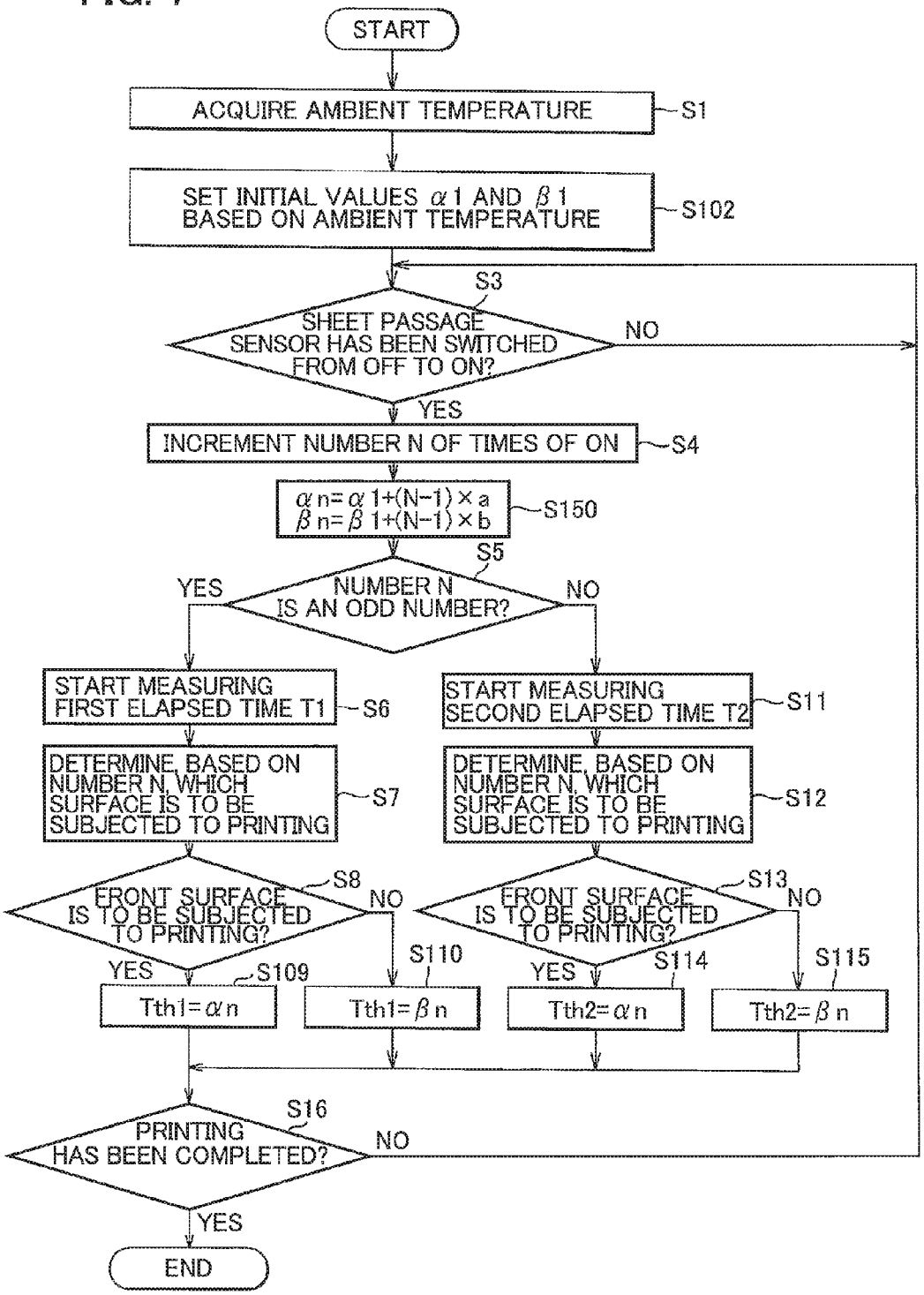
FIG. 7 is a flowchart illustrating the process for setting threshold values according to a modification.

Specifically, in this modification, the controller 300 sets the threshold values Tth1 and Tth2 by executing the flowchart of FIG. 7, in place of the flowchart of FIG. 4. A process of S102 is provided in place of the process of S2 in FIG. 4, a process of S150 is added between the processes of S4 and S5 in FIG. 4, and process of S109, S110, S114, and S115 are provided in place of the processes of S9, S10, S14, and S15 in FIG. 4.

In S102, the controller 300 sets an initial value α1 of the first start period and an initial value β1 of the second start period based on the ambient temperature and the map illustrated in FIG. 3. In S150, the controller 300 calculates a current value an of the first start period according to the following expression (1) and calculates a current value βn of the second start period according to the following expression (2):

$$\alpha n=\alpha 1+(N-1)\times a \quad (1)$$

$$\beta n=\beta 1+(N-1)\times b \quad (2)$$

where "N" is the number of times of "ONs", and "a" and "b" are positive values.

Because the values αn and βn are calculated according to the above-described expressions (1) and (2), the values αn and βn gradually increase with an increase in the number N of times of "ON".

In S109, the controller 300 sets the current value an of the first start period as the first timer threshold value Tth1. In S110, the controller 300 sets the current value βn of the second start period as the first timer threshold value Tth1.

In S114, the controller 300 sets the current value an of the first start period as the second timer threshold value Tth2. In S115, the controller 300 sets the current value βn of the second start period as the second timer threshold value Tth2.

While the controller 300 executes the continuous single-sided printing on a plurality of sheets P in succession, the controller 300 executes the above-described control as illustrated in FIG. 8 such that the first start period gradually increases in accordance with an increase in the number N of times of "ON". In other words, the values α1, α2, α3, . . . , and α10 of the first start period satisfy the following relationship: α1<α2<α3, . . . , <α10. That is, the first start period "αN" gradually increases as the suffix "N" being indicative of the times of "ON" increases.

By gradually increasing the first start period with an increase in the number N of times of "ON", the length of the execution time period Td of the high-output tendency control gradually decreases as the number N of times of "ON" increases. That is, the amount of heat generated under the high-output tendency control gradually decreases.

In the case of double-sided printing, both of the first and second start periods gradually increase with an increase in the number N of times of "ON", whereby the amount of heat generated under the high-output tendency control gradually decreases both at the front surface fixing time and at the back surface fixing time.

As the number N of times of "ON" increases, that is, as the number of prints increases, the period of time during which the heater 101 has been heated by the halogen lamp 120 increases, and therefore the amount of heat accumulated in the heater 101 increases. According to this modification, as the amount of heat accumulated in the heater 101 increases, the amount of heat generated under the high-output tendency control is gradually decreased. Accordingly, sheets P can be prevented from being excessively heated when the number of prints becomes large.

When the number of prints becomes so large that the values of αn and βn become longer than or equal to the end period τ, the controller 300 does not perform the high-output tendency control substantially. That is, the controller 300 is configured not to perform the high-output tendency control when the number of prints becomes equal to or larger than a predetermined value. This configuration can be applied also to the embodiment described above.

In the above-described embodiment, the controller 300 performs the high-output tendency control by setting the target temperature TE to the second target temperature TE2 and feedback controlling the output of the halogen lamp 120 so that the temperature detected by the second temperature sensor ST2 (temperature of the endless belt 110) will approach the second target temperature TE2. However, the controller 300 may perform the high-output tendency control by using other methods. For example, the controller 300 may not perform the feedback control on the halogen lamp 120. That is, the controller 300 may perform the high-output tendency control, without setting the target temperature. The controller 300 may perform the high-output tendency control by simply setting the output of the halogen lamp 120 to a specified high output value, such as 100%. In other words, the controller 300 may forcibly set the specified high output value. By thus forcibly setting the specified high output value, the controller 300 controls the halogen lamp 120 to output the specified high output value. Similarly, in the above-described embodiment, the controller 300 performs the low-output tendency control by setting the target temperature TE to the first target temperature TE1 and feedback controlling the output of the halogen lamp 120 so that the temperature detected by the second temperature sensor ST2 (temperature of the endless belt 110) will approach the first target temperature TEL However, the controller 300 may perform the low-output tendency control by using other methods. For example, the controller 300 may not perform the feedback control on the halogen lamp 120. That is, the controller 300 may perform the low-output tendency control, without setting the target temperature. The controller 300 may perform the low-output tendency control by simply setting the output of the halogen lamp 120 to a specified low output value, such as 0%. In other words, in the low-output tendency control, the controller 300 may forcibly set the specified low output value, which is lower than the high output value that the controller 300 forcibly sets in the high-output tendency control. By thus forcibly setting the specified low output value, the controller 300 controls the halogen lamp 120 to output the specified low output value.

As the high-output tendency control, such a method can be adopted, in which a predetermined value X1 is subtracted from the temperature measurement value obtained by the temperature sensor ST2, thereby obtaining a decreased temperature value. The heater 101 is controlled based on a comparison result between the decreased temperature value and the target temperature. According to this method, both of the high-output tendency control and the low-output tendency control are performed by using the same target temperature and subtracting the predetermined value from the temperature measurement value only during the high-output tendency control. It is noted that in the low-output tendency control, a predetermined value X2, which is smaller than X1, may be subtracted from the measurement temperature value.

In the above-described embodiment, the amount of heat generated by the halogen lamp 120 under the high-output tendency control is changed by changing the length of the period of time, during which the high-output tendency control is executed. However, the amount of heat generated by the halogen lamp 120 under the high-output tendency control may be changed by using other methods. For example, the amount of heat generated by the halogen lamp 120 may be changed by changing the output value of the halogen lamp 120 under the high-output tendency control.

In the above-described embodiment, the length of the execution time period of the high-output tendency control is changed by changing the start period of the high-output tendency control. However, the length of the execution time period of the high-output tendency control may be changed by using other methods. For example, the length of the execution time period of the high-output tendency control may be changed by changing the end period of the high-output tendency control.

According to the above-described embodiment, the halogen lamp 120 is used as the heat source. Examples of the heat source, other than the halogen lamp, include: a heating resistor; a carbon heater; a ceramic heater; and such a type of heat source that includes a combination of an IH heat source and a heat generating member that generates heat by the IH heat source. Here, the IH heat source itself does not generate heat, but permits a roller or a metal belt to generate heat according to an electromagnetic induction heating method.

Further, in the above-described embodiment, a thick sheet, a postcard, and a thin sheet are available as the sheet P, but are not limited thereto. For example, an OHP sheet is also available as the sheet P.

Further, in the above-described embodiment, the heater 101 includes the endless belt 110 and the nip plate 130. However, a metallic heat roller in which a halogen lamp is disposed is also available as the heater 101.

Further, in the above-described embodiment, the color printer 1 is the example of the image forming apparatus. However, a copying machine and a multi-function peripheral is also available as the image forming apparatus.

While the description has been made in detail with reference to the specific embodiment and modification thereof, it would be apparent to those skilled in the art that various changes and modifications may be made therein without departing from the spirit and scope of the above described embodiment and modification.

What is claimed is:

1. An image forming apparatus comprising:

a heating body configured to thermally fix developing agent onto a recording sheet;

a heat source configured to heat the heating body;

an electric power supply configured to supply electric power to the heat source;

a conveying mechanism configured to convey the recording sheet to the heating body; and a controller configured to control the electric power supply and the conveying mechanism, the controller being configured to perform:

executing a continuous conveying process to control the conveying mechanism to continuously convey a plurality of recording sheets in succession to the heating body;

while executing the continuous conveying process, executing a first output process at a timing prior to a prescribed timing, the first output process being for controlling the electric power supply to output electric power to the heat source, the prescribed timing being prior to a timing at which each recording sheet reaches the heating body; and while executing the continuous conveying process, executing a second output process for a prescribed period from the prescribed timing, the second output process being for controlling the electric power supply to output electric power to the heat source such that an output level of the electric power that is outputted from the electric power supply in the second output process has a tendency to become higher than an output level of the electric power that is outputted from the electric power supply in the first output process.

2. The image forming apparatus according to claim 1, further comprising a temperature sensor configured to detect temperature of the heating body, and wherein in the first output process, the controller is configured to perform:

setting a target temperature to a first target temperature; and adjusting the electric power outputted from the electric power supply on the basis of both of a measurement value of the temperature sensor and the first target temperature, and wherein in the second output process, the controller is configured to perform:

setting the target temperature to a second target temperature such that the second target temperature is higher than the first target temperature; and adjusting the electric power outputted from the electric power supply on the basis of both of the measurement value of the temperature sensor and the second target temperature.

3. The image forming apparatus according to claim 1, wherein the controller executes the second output process repeatedly such that a succeeding second output process is executed after a preceding second output process is executed, and wherein the controller executes the first output process during an entire length of a period between a preceding second-output process period and a succeeding second-output process period, the preceding second-output process period being a period in which the preceding second output process is executed, and the succeeding second-output process period being a period in which the succeeding second output process is executed.

4. The image forming apparatus according to claim 1, wherein the controller executes the first output process at a timing that corresponds to an interval, in which no recording sheet exists at the heating body.

5. The image forming apparatus according to claim 1, wherein the controller sets a length of the prescribed period to a single-side execution time length when executing the second output process in correspondence with a timing at which a recording sheet, whose one surface has been formed with an image and whose other surface has not been formed with an image, reaches the heating body, and wherein the controller sets the length of the prescribed period to a double-side execution time length when executing the second output process in correspondence with a timing at which a recording sheet, whose both surfaces have been formed with images, reaches the heating body, and wherein the double-side execution time length is shorter than the single-side execution time length.

6. The image forming apparatus according to claim 1, wherein the controller is configured such that while executing the continuous conveying process, the controller changes a length of the prescribed period such that the length of the prescribed period decreases in accordance with an increase of a total amount of the recording sheets that have been conveyed in the continuous conveying process.

7. The image forming apparatus according to claim 1, further comprising:

a housing; and a temperature sensor configured to detect temperature inside the housing, wherein the controller sets a length of the prescribed period such that the length of the prescribed period decreases in accordance with an increase of a measurement value of the temperature sensor.

8. The image forming apparatus according to claim 1, further comprising a sheet sensor disposed at a position upstream of the heating body in a conveying direction in which the conveying mechanism conveys the recording sheets and configured to detect a recording sheet being conveyed past the sheet sensor, and wherein the controller determines whether the prescribed timing is reached, on the basis of a detection result of the sheet sensor.

9. The image forming apparatus according to claim 8, wherein the controller is configured such that while executing the continuous conveying process, the controller changes a length of the prescribed period, in which the second output process is executed.

10. The image forming apparatus according to claim 9, wherein the controller is configured to change the length of the prescribed period by changing a start timing relative to a detection timing, the start timing being defined as a timing at which the controller starts executing the second output process, and the detection timing being defined as a timing at which the sheet sensor detects that a recording sheet is conveyed past the sheet sensor.

11. The image forming apparatus according to claim 10, wherein the controller is configured to set a start-timing changing amount and a termination-timing changing amount such that the start-timing changing amount is greater than the termination-timing changing amount, the start-timing changing amount being defined as an amount by which the start timing relative to the detection timing is changed while the continuous conveying process is being executed, and the termination-timing changing amount being defined as an amount by which the termination timing relative to the detection timing is changed while the continuous conveying process is being executed, and the termination timing being defined as a timing at which the controller terminates execution of the second output process.

12. The image forming apparatus according to claim 11, wherein the controller is configured to set, to zero (0), the termination-timing changing amount.

13. The image forming apparatus according to claim 9, wherein the controller is configured to change the length of the prescribed period such that a maximum value of the length of the prescribed period is shorter than a length of time it takes for the conveying mechanism to convey a single recording sheet past the heating body.

14. The image forming apparatus according to claim 9, wherein the heating body includes at least one of a roller and an endless belt, both of which is configured to rotate relative to the heat source, and wherein the controller is configured to change the length of the prescribed period such that a minimum value of the length of the prescribed period is longer than a length of time it takes for the heating body to rotate a single turn.

15. A method for controlling an electric power supply to supply electric power to a heat source and control a conveying mechanism to convey a recording sheet, the heat source being configured to heat a heating body, and the heating body being configured to thermally fix developing agent onto a recording sheet conveyed by the conveying mechanism, the method comprising:

executing a continuous conveying process to control the conveying mechanism to continuously convey a plurality of recording sheets in succession to the heating body;

while executing the continuous conveying process, executing a first output process at a timing prior to a prescribed timing, the first output process being for controlling the electric power supply to output electric power to the heat source, the prescribed timing being prior to a timing at which each recording sheet reaches the heating body; and while executing the continuous conveying process, executing a second output process for a prescribed period from the prescribed timing, the second output process being for controlling the electric power supply to output electric power to the heat source such that an output level of the electric power that is outputted from the electric power supply in the second output process has a tendency to become higher than an output level of the electric power that is outputted from the electric power supply in the first output process.

16. The method according to claim 15, wherein the executing the first output process comprises:

setting a target temperature to a first target temperature; and adjusting the electric power outputted from the electric power supply on the basis of both of the first target temperature and a measurement value of a temperature sensor indicative of temperature of the heating body, and wherein the executing the second output process comprises:

setting the target temperature to a second target temperature such that the second target temperature is higher than the first target temperature; and adjusting the electric power outputted from the electric power supply on the basis of both of the second target temperature and the measurement value of the temperature sensor.

17. The method according to claim 15, wherein the second output process is executed repeatedly such that a succeeding second output process is executed after a preceding second output process is executed, and wherein the first output process is executed during an entire length of a period between a preceding second-output process period and a succeeding second-output process period, the preceding second-output process period being a period in which the preceding second output process is executed, and the succeeding second-output process period being a period in which the succeeding second output process is executed.

18. A non-transitory computer-readable recording medium storing computer-readable instructions for a controller, the controller being configured to control an electric power supply to supply electric power to a heat source and control a conveying mechanism to convey a recording sheet, the heat source being configured to heat a heating body, the heating body being configured to thermally fix developing agent onto a recording sheet conveyed by the conveying mechanism, the computer-readable instructions, when executed by a processor of the controller causing the controller to perform:

executing a continuous conveying process to control the conveying mechanism to continuously convey a plurality of recording sheets in succession to the heating body;

while executing the continuous conveying process, executing a first output process at a timing prior to a prescribed timing, the first output process being for controlling the electric power supply to output electric power to the heat source, the prescribed timing being prior to a timing at which each recording sheet reaches the heating body; and while executing the continuous conveying process, executing a second output process for a prescribed period from the prescribed timing, the second output process being for controlling the electric power supply to output electric power to the heat source such that an output level of the electric power that is outputted from the electric power supply in the second output process has a tendency to become higher than an output level of the electric power that is outputted from the electric power supply in the first output process.

19. The non-transitory computer-readable recording medium according to claim 18, wherein the executing the first output process comprises:

setting a target temperature to a first target temperature; and adjusting the electric power outputted from the electric power supply on the basis of both of the first target temperature and a measurement value of a temperature sensor indicative of temperature of the heating body, and wherein the executing the second output process comprises:

setting the target temperature to a second target temperature such that the second target temperature is higher than the first target temperature; and adjusting the electric power outputted from the electric power supply on the basis of both of the second target temperature and the measurement value of the temperature sensor.

20. The non-transitory computer-readable recording medium according to claim 18, wherein the second output process is executed repeatedly such that a succeeding second output process is executed after a preceding second output process is executed, and wherein the first output process is executed during an entire length of a period between a preceding second-output process period and a succeeding second-output process period, the preceding second-output process period being a period in which the preceding second output process is executed, and the succeeding second-output process period being a period in which the succeeding second output process is executed.

* * * * *